United States Patent [19]

Minogue

[11] 4,434,569

[45] Mar. 6, 1984

[54] CONNECTOR HOUSING FOR NEON TUBING

[76] Inventor: Robert W. Minogue, 25200 Carlos Bee Blvd., Hayward, Calif. 94542

[21] Appl. No.: 272,630

[22] Filed: Jun. 11, 1981

[51] Int. Cl.[3] ..... G09F 13/22

[52] U.S. Cl. ..... 40/545; 40/558; 339/50 R

[58] Field of Search ..... 40/541, 545, 552, 558; 339/191-194, 50 R, 57; 361/331; 362/226, 362

[56] References Cited

U.S. PATENT DOCUMENTS

| | | | |
|---|---|---|---|
| 1,668,606 | 5/1928 | Roberts | 339/191 R |
| 1,757,437 | 5/1930 | Muldoon | 339/191 S |
| 1,904,889 | 4/1933 | Strongson | 339/191 S |
| 1,956,725 | 5/1934 | Mitchell | 339/50 R |
| 2,007,443 | 7/1935 | Feuchter | 339/191 S |
| 2,015,442 | 9/1935 | Sprung | 339/50 R |
| 2,136,057 | 11/1938 | Olshansky | 339/191 A |
| 2,245,681 | 6/1941 | Kenigsberg | 40/545 |
| 2,296,326 | 9/1942 | Barclay | 339/57 |
| 2,548,371 | 4/1951 | Hoard | 339/191 R |
| 2,695,389 | 11/1954 | Mackey | 339/57 |
| 2,853,819 | 9/1958 | Leesch | 40/545 |
| 2,924,034 | 2/1960 | Leeds | 40/545 |
| 4,223,377 | 9/1980 | Williams | 362/362 |

*Primary Examiner*—Gene Mancene
*Assistant Examiner*—David L. Tarnoff
*Attorney, Agent, or Firm*—Townsend and Townsend

[57] ABSTRACT

A connector is fabricated from dielectric material, typically ceramic, to enable the isolated assembly of neon connections, the plugging in of neon tubes, and the maintenance of high voltage neon connections (in the order of 30,000 volts). The connector includes a dielectric housing and separate dielectric cover plate with an optional silicon rubber gasket therebetween. In connector assembly, commonly bound, oppositely-polarized high voltage wires enter a common chamber defined between the backside of the housing and the mounting. On the front side of the housing are first and second paired and communicated chamber sets. Each set of chambers includes a connector chamber and a tube receiving chamber. The connector chamber receives an insulated wire of one polarity from the common housing at the connector back and provides an isolated dielectric cavity in which the wire is stripped and electrical conductor connection made. This electrical conductor communicates to the tube chamber through a threaded bolt and attached spring. Once stripping and connection of the wire in the connection chamber has occurred, the housing is capped with the cover and the neon tube plugged into the tube chamber. The tube chamber is provided with a long electric connection channel, which receives the tube at one end. This tube chamber is provided with a length that isolates the connection of the tube in a dielectrically enclosed environment and contains a conductive spring to make the desired connection.

7 Claims, 9 Drawing Figures

CONNECTOR HOUSING FOR NEON TUBING

This invention relates to receptacles for electrodes and more particularly to a receptacle design to receive capped conductive ends of neon tubes in side by side plugged relation.

SUMMARY OF THE PRIOR ART

High voltage connections to neon signs are a known source of hazard. The most commonly known and used form of neon sign connection is disclosed in FIG. 1; reference to this figure can point out some of the disadvantages accruing from the prior art.

Heretofore neon sign connectors have been used to penetrate not only the sign backing but typically the wall to which such connectors are attached. Referring to FIG. 1, a connector is illustrated having a glass plug 14 mounted over a glass body 16 with body 16 being enclosed interiorly of an all metal housing 18. Connector C accommodates tube end E interiorly thereof. the connectors C are typically individually mounted and used not only as the point of electrical connection for the neon sign constituents but additionally as the conduits through which the high voltage current (in the order of 30,000 volts) passes with respect to the wall. Connector 20 is made to connect the current to the transformer through the combination of connector parts including threaded shaft 21, and bolt 22 holding the metal cap over the glass connector and wire 23 communicating current to the sign.

Taking the case of an operating sign during a rainstorm, failures of such connectors can be easily understood. Specifically, the connectors get hot due to the ambient heat from the sign. When they are hot, breakage of the tube, the glass plug 14 or the inner glass plug 16 can occur, especially when water penetrates the electrical connection. Experience with such signs teaches that when these breakages occur, often the full time voltage in the order of 30,000 volts remains across the sign. Arcing between the wall portion, transformer housing or othe conductive members in the building can and does periodically occur. The result is at a minimum an electric shortcircuit and often results in fire.

Having set forth the most common electrical connector, reference now can be made to various alternate patented connectors.

Mitchell U.S. Pat. No. 1,956,725 and Miller U.S. Pat. No. 2,374,228 shows separate housings for separate polarities. They are similar to the embodiment illustrated in FIG. 1 in that each electrical housing for each side of the voltage potential used for sign illumination is mounted in and to a separate housing. Either tube ending spacing or alternatively sign tip ending spacing must be manufactured in anticipation of the particularized custom sign being made. The receptacles there shown are not suitable for plugging both sign ends, and only series connections between tube ends of the same potential can be made. Barclay U.S. Pat. No. 2,296,326 and McKay U.S. Pat. No. 2,695,389 illustrate connectors in which the tube connection is made first and covering occurs second. No provision is made for plugging in adjacent spaced relationship tube endings of opposite potential. Moreover, plugging of tube without exposing the electrical connection is not provided for.

SUMMARY OF THE INVENTION

A connector is fabricated from dielectric material, typically ceramic, to enable the isolated assembly of neon connections,the plugging in of neon tubes, and the maintenance of high voltage neon connections (in the order of 30,000 volts). The connector includes a dielectric housing and separate dielectric cover plate with an optional silicon rubber gasket therebetween. In connector assembly, commonly bound, oppositely-polarized high voltage wires enter a common chamber defined between the backside of the housing and the mounting. On the front side of the housing are first and second paired and communicated chamber sets. Each set of chambers includes a connector chamber and a tube receiving chamber. The connector chamber receives an insulated wire of one polarity from the common housing at the connector back and provides an isolated dielectric cavity in which the wire is stripped and electrical conductor communicates to the tube chamber through a threaded bolt and attached spring. Once stripping and connection of the wire in the connection chamber has occurred, the housing is capped with the cover and the neon tube plugged into the tube chamber. The tube chamber is provided with a long electric connection channel, which receives the tube at one end. This tube chamber is provided with a length that isolates the connection of the tube in a dielectrically enclosed environment and contains a conductive spring to make the desired connection.

OBJECTS, FEATURES AND ADVANTAGES

An object of this invention is to provide a plut and connector having parallel channels to receive neon tube ends of opposite polarity in side by side relation in an electrically isolated environment. According to this aspect of the invention, the connector provides paired and side-by-side dielectrically insulated and open cavities, each having a length substantially exceeding the conductive tube cap on the end of neon tubing. These respective tube receiving apertures open to the side of the connector at one end, contain an isolated connected spring at their innermost extremity at the opposite end and assure by their length electrical contact being made in an isolated dielectric environment.

An advantage of the aspect of this invention is that the high voltage (30,000 volts) electrical connection is made between the spring and neon tube cap in an isolated environment. Neither the dielectric housing nor the glass neon tube can conduct the resultant voltage exterior of the connection.

An additional advantage of this invention is that a single connector is capable of connecting sign ends of opposite polarity; side-by-side spaced apart electrical connections in the order of 30,000 volts can be made to standard dimensions and thereafter installed and replaced with relative ease by simply "plugging in" to the open tube receiving housing.

Yet another advantage of this invention is that the housing itself forms no part of the penetration of the sign back or partition to which the sign is attached. Instead, commonly bound electrical conduit is used to make this connection. As such commonly bound electrical conduit is a tried and tested source of partition penetration, incidences of connector breakage do not release high voltage in partitions where fire hazards occur.

Yet another advantage of this invention is that the respective tubes may be replaced without connector disassembly.

A further object of this invention is to provide a connector which is assembled at the site of its use in the safest possible sequence. According to this aspect of the invention, the commonly bound wire is pulled and split through the partition in the sign backing. The connections of opposite potential are thereafter taken from a common chamber at the connector rear and passed through to respective paired connection chambers. The main sign housing is mounted to the sign backing with the wires of opposite potential protruding into dielectrically separate cavities formed by discrete chambers, one for each polarity. The wire in each cavity is thereafter connected to a screw connector. This screw connector provides the electrical path to the tube channel and serves as the physical fastening point for the connecting helical and/or spirally wound spring. Once connection of each stripped conduit is made, the housing is covered, completely isolating all electrical connections. Thereafter, the neon tube is plugged to the connector and power supplied to the sign.

An advantage of this aspect of the invention is that the disclosed assembler connection sequence is completely compatible with existing signs and blown tube designs. The connector is easily understood. Moreover, connector disassembly is not required on tube replacement.

Yet another advantage of this invention is that the connector is completely mounted on one side of the sign. Heat dissipation from the connector ends occurs with a uniformity that neither stresses the connector or the tube ends nor passes to the partition penetrating conduit in a manner likely to cause damage and resultant fire.

Other objects, features and advantages of this invention will become more apparent after referring to the following specification and attached drawings in which:

FIG. 3B shows the housing mounted and two conduits of opposite polarity stripped and mounted to their respective connector;

FIG. 3C shows the cover mounted over the connector; and,

FIG. 3D illustrates the tube being plugged in with one of the tube connectors being broken away so that the isolated electrical connection upon plugging of the neon tube can be seen and understood.

Figure 2A:
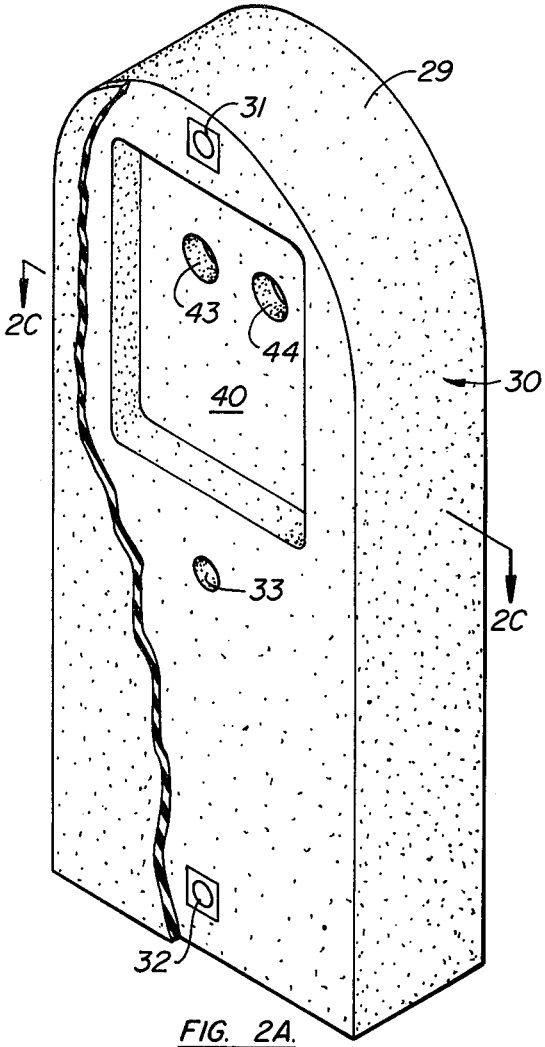
FIG. 2A is a perspective view of the housing back.
Figure 2B:
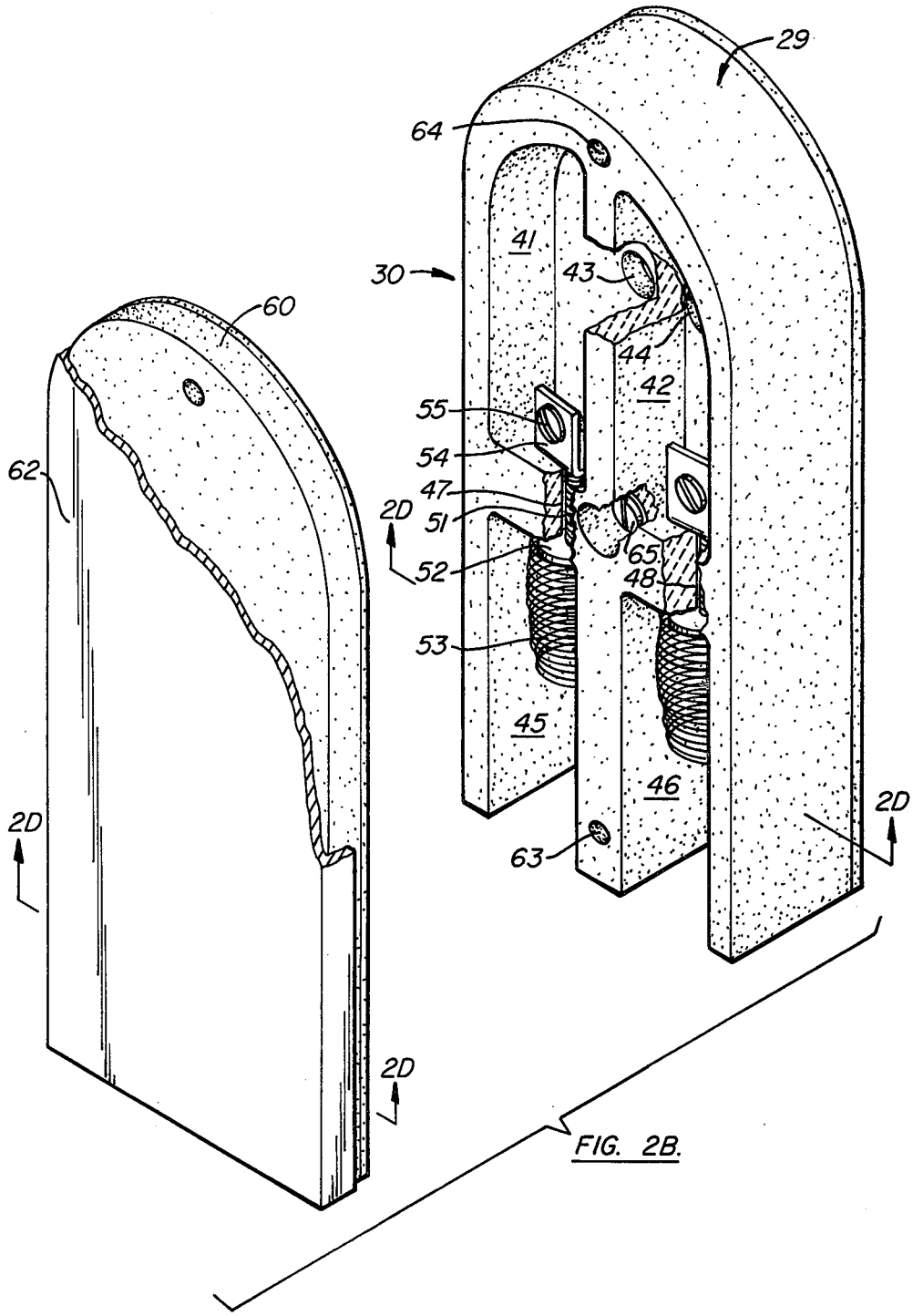
FIG. 2B is a perspective view of the housing front with the cover exploded illustrated alongside.

Referring to FIGS. 2A and 2B, the overall configuration of this housing can be understood. During the description of this invention, it will be understood that the design of the housing has occurred so that fabrication can occur in a two part mold, such as commonly used to receive and form ceramic. A unitized housing is disclosed, the back of which is shown in FIG. 2A. The housing is of generally rectangular shape with end 29 being rounded.

The housing is transpierced at three apertures 31, 32 and 33. Apertures 31 and 32 serve to permit both mounting of the covering and fastening of the connector to a sign back. Aperture 33 permits attachment of the cover to the sign back during connector assembly.

At the back of the connector, a common chamber 40 is formed. Chamber 40 is the area to which the commonly bound electrical connector of the sign is pulled and thereafter split. When the cover is mounted to the sign backing, this common chamber 40 provides an isolated environment in which the conduit is split and channeled to the respective paired chambers.

On the opposite side of the connector housing from common chamber 40 are paired connection chambers 41, 42. Each of these chambers 41, 42 is for making a connection of opposite polarity. Thus in the main body of the connector 30, these members comprise dielectrically isolated concavities.

Extending between common chamber 40 and each of the connection chambers 41, 42 are apertures 43, 44. It is through these apertures that each of the split conduits from the common conduits are led. Opposite from end 29 of the connector housing 30 and at the squared end of the connector are paired and spaced apart tube receiving chambers 45, 46. These chambers are each given a length with respect to the conducting end of the neon tubing so that the conductive portions of the neon tube when connected are fully within the tube chamber and are impossible to either see or touch. The spacial recess of the tube chambers are such tha electrical arcing of electrical current from the contacting conductors within the chambers cannot penetrate outside of the chambers.

Attention may now be given to the electrical interconnecting parts which are fastened to the connector.

Chambers 45 and 41 are connected by an aperture 47; similarly chambers 46 and 42 are connected by an aperture 48. Identical members form the electrical connection between the respective chambers 41, 42 on one hand and 45, 46 on the other hand. Only the connector that extends between chambers 41, 45 will be described.

It will be seen that a screw 51 has washer 52 and connected helical and spirally wound spring 53 for making the ultimate connection. Screw 51 has threaded to the opposite end thereof an L-shaped angle clamp 54. The other angle of the L-shaped clamp has a fastening screw 55 threaded thereto. This fastening screw 55 is disposed within connection chamber 41 and accepts the stripped end of the connector. Thus it can be seen that the electrically interconnecting parts fasten to the aperture 47 in a dielectrically isolated environment and are of extreme mechanical simplicity for effecting the desired connection.

In the installation of such connectors, the L-shaped clamp 54 with screw 55 and spring 53 already attached is held in place. Thereafter, a screwdriver is moved axially into the tube connection chamber 45. By rotation of screw 51, the spring 53, washer 52 and L-shaped bracket 54 are all held in place.

An identical threaded connection is made on the opposite side.

Once these connections are made, the cover 60 with a reinforcing plate 62 is mouned ove the connected housing. Screws 63, 64 along the screw 65 that has been used to hold the housing in place fasten the cover. Once the cover is fastened, plugging can occur.

Having set forth the configuration of the housing, attention will now be given briefly to the assembly sequence such as is illustrated in FIGS. 3A–3D.

Figure 1:
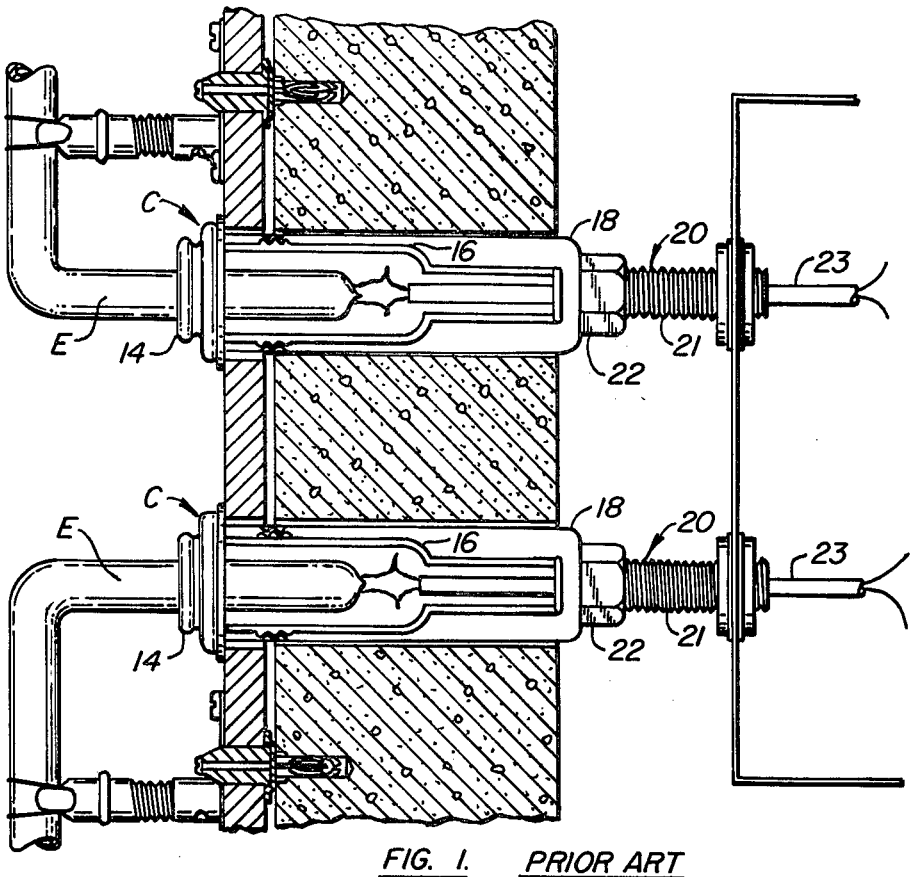
FIG. 1. PRIOR ART
FIG. 1 is an illustration of prior art connectors now in use, which connectors have been previously described.
Figure 2C:
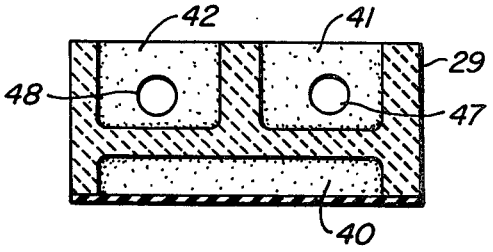
FIG. 2C is a section along line 2C—2C of FIG. 2A.
Figure 2D:
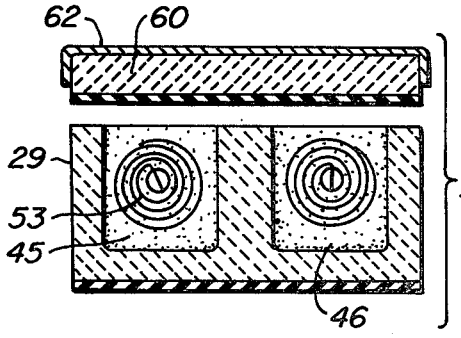
FIG. 2D is a section along line 2D—2D of FIG. 2B.
Figure 3A:
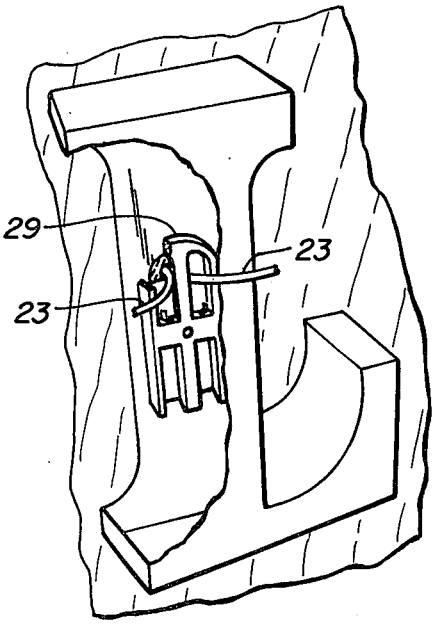
FIGS. 3A–3D are a cartoon sequence illustrating the installation of the connector of this invention with FIG. 3A illustrating the commonly bound conduit hole through the partition and sign back with the common concavity at the connector back being shown covering the pulled conduit and having the two leads of opposite polarity pulled through to their respective connection chambers.
Figure 3B:
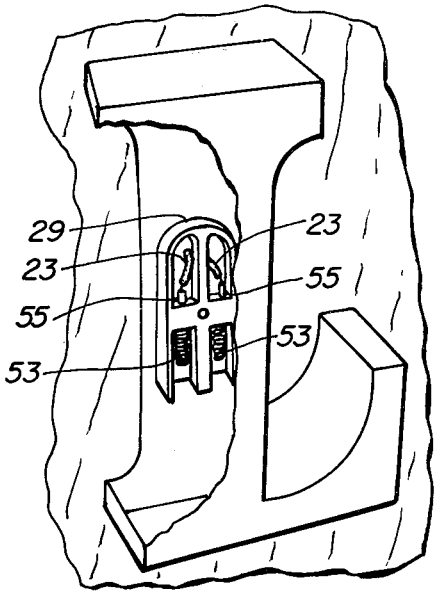
Figure 3C:
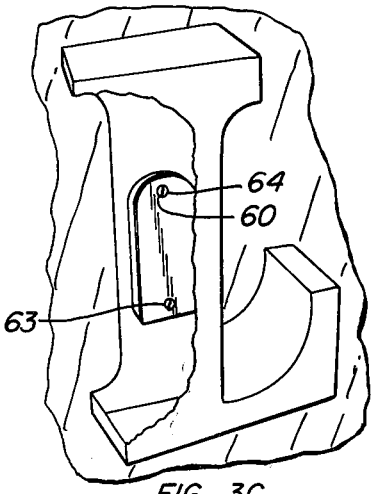
Figure 3D:
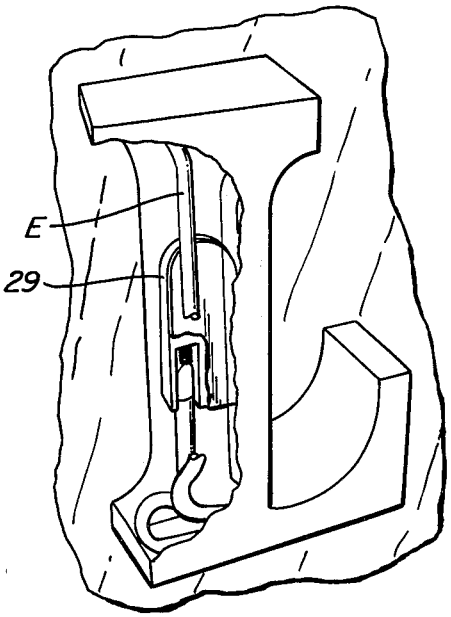

Referring to FIGS. 3A through 3D, the process of installing a dielectric connector to a sign is included. As FIG. 1 the step of providing the illustrated dielectric connector is illustrated. This connector defines a common concavity on the back side of the connector and has two parallel and spaced apart tube receiving chambers. In installation, the step of drilling a conduit communicating aperture through the sign back and pulling commonly bound conduit through the sign back is shown in FIG. 3A. Further and as shown in FIG 3A, splitting the conduit occurs with the conduit thereafter being threaded from the common concavity into each aperture of the pllug. Referring to FIG. 3B, conduit ends in the discrete chambers are each threaded along discretely separated paths each in their own tube receiving conduit. Connection is made as illustrated in FIG. 3B. A dielectric cover for encasing connections is placed over the connected apparatus of FIG. 3B as shown in FIG. 3C. Finally, neon tubes having parallel endings are plugged into the tube receiving aperture.

What is claimed is:

1. A connector for receiving the paired ends of conductive neon tubing for mounting to a sign backing, said connector comprising in combination: a dielectric housing having a side exposed to said sign backing; said side having a recess therein; said recess in cooperation with said sign backing defining a common cavity sufficient to receive and split electrical conduit into two conductors; paired dielectrically isolated side-by-side tube receiving chambers extending in spaced-apart parallel relation to said side of said dielectric housing and opening to the exterior of said housing; each of said tube receiving chambers having tube connector means disposed interiorly thereof for making an enclosed electrical connection to an inserted neon tube; dielectrically isolated paired paths for threading each of said conductors between said common cavity at one end and one of said neon tubes at the other end; and connection means interior of said connector for connecting said tube connector means to said conductors.

2. The invention of claim 1 and wherein each of said paired paths includes a connection cavity disposed between one of said tube receiving chambers and said common cavity, a conductor communicating path extending between said common cavity and said connection cavity, and conductive fastening means for fastening one of said conductors to said tube connector means.

3. The invention of claim 2 and wherein said tube connector means includes a spring disposed within said tube receiving chamber for effecting electrical connection to said neon tube, and wherein said conductive fastening means includes a bracket disposed within said connection cavity for connection to said conductor, and a screw contacting said spring and threadedly engaged to said bracket.

4. In combination a neon sign having a sign back; a neon tube wound in a serpentine path, said tube having conductive ends spaced in side-by-side parallel spaced apart relation; a dielectric housing mounted to a sign back; said dielectric housing defining a common cavity in conjunction with said sign back to receive conduit passing through the back of said sign; commonly bound conduits extending through the back of said sign to said common cavity, said commonly bound conduits split in said common cavity; first and second parallel spaced apart tube connection chambers for receiving the respective tube ends of said sign, said chambers being elongated in length a sufficient distance to cover completely conductive portions of the tube ends of said sign, said first and second spaced apart tube connection chambers in identical side-by-side relation to said neon tube ends; conductor paths extending between said common acvity on one end and said tube receiving chambers on the other end; connection means communicated at one end of said tube receiving chambers for making dielectrically isolated connection interiorly of said connector and having split wires passing discretely within each isolated chamber to communicate electrical power of opposite polarity to respective tubes received interiorly of each of said chambers.

5. A process of installing a dielectric connector to a sign including the steps of providing a dielectric connector having a defined common concavity on one end and two parallel and spaced apart tube receiving chambers on an opposite end; drilling a conduit communicating chamber through a sign back and pulling commonly bound conduit therethrough; splitting said conduit; threading said conduit from said common concavity into said tube receiving chambers; threading among discretely separate paths between said common conduit and said tube receiving conduit; and providing biased connecting means in the interior portion of said tube receiving conduit; and; connecting said biased connecting means and covering said connecting means with a dielectric cover.

6. The process of claim 5 and including providing neon tubes having parallel and spaced apart ends complementary to said tube receiving chambers; and plugging said ends into said dielectric connector at said tube receiving chambers.

7. The process of claim 6 and providing a dielectric cover for encasing said connection advance of said plugging step.

* * * * *